US007909100B2

(12) United States Patent
Bryant, Jr. et al.

(10) Patent No.: US 7,909,100 B2
(45) Date of Patent: Mar. 22, 2011

(54) REVERSIBLE CASING CUTTER

(75) Inventors: Charles Larue Bryant, Jr., LaPlace, LA (US); David J. Ruttley, Marrero, LA (US)

(73) Assignee: Deltide Fishing & Rental Tools, Inc., Harvey, LA (US)

( * ) Notice: Subject to any disclaimer, the term of this patent is extended or adjusted under 35 U.S.C. 154(b) by 142 days.

(21) Appl. No.: 12/215,265

(22) Filed: Jun. 26, 2008

(65) Prior Publication Data

US 2009/0321063 A1 Dec. 31, 2009

(51) Int. Cl.
*E21B 29/00* (2006.01)

(52) U.S. Cl. ..... 166/298; 166/55.7; 166/55.8; 175/266; 175/269

(58) Field of Classification Search ..... 166/298, 166/55.6, 55.7, 55.8; 175/265, 266, 269
See application file for complete search history.

(56) References Cited

U.S. PATENT DOCUMENTS

| | | | | |
|---|---|---|---|---|
| 2,353,284 | A * | 7/1944 | Barrett | 166/55.8 |
| 2,482,674 | A * | 9/1949 | Kriegel | 166/55.8 |
| 2,735,485 | A * | 2/1956 | Metcalf | 166/55.8 |
| 5,242,017 | A * | 9/1993 | Hailey | 166/55.8 |
| 5,265,675 | A * | 11/1993 | Hearn et al. | 166/297 |
| 7,063,155 | B2 | 6/2006 | Ruttley | |

* cited by examiner

*Primary Examiner* — Giovanna C Wright
(74) *Attorney, Agent, or Firm* — Law Office of Jesse D. Lambert, LLC

(57) ABSTRACT

Casing cutter for severing multiple tubulars in a well bore has a pair of cutter blades pivotally mounted on a support body. The blades are pivotally mounted for gradual movement outside of the support body when downward force is applied to proximate ends of the cutter blades. The support body is rotated inside the innermost of the multiple tubulars, while the cutter blades sever the tubulars of progressively increasing diameter. Should the cutter blades or pivotal connections become unusable, the tool body can be rotated about the vertical axis and secured to a downhole string by the opposite end. A substitute pair of cutter blades are then engaged on the tool body and operated to cut the casings similar to the first set of the cutter blades.

25 Claims, 5 Drawing Sheets

REVERSIBLE CASING CUTTER

FIELD OF THE INVENTION

The present invention relates to the field of gas and petroleum exploration and production and, more particularly, to an apparatus for cutting multiple tubulars, such as casings in a well bore.

BACKGROUND OF THE INVENTION

In the offshore industry, the exploration and production of gas and petroleum is conducted through tubulars of various diameters that are cemented inside each other and extend to a distance below the sea floor, where the production zone is located. When the well is abandoned, the owner of the offshore rig is required to remove the casing at the depth of 20 feet below the mud line. After the casing is cut, the rig owner must cement the plug on the abandoned well to protect the marine life in the surrounding area.

To perform the cutting operation below the mud line, a cutting tool is lowered into the innermost casing, which usually has a relatively small diameter, and severs the tubulars. When the first inside casing is removed, another cutter with greater cutting diameter is lowered inside the pipe and the next diameter conduit is cut in a similar manner. This procedure continues until the multiple tubulars are cut at the required depth.

Conventionally, the industry uses a three-blade cutting tool, which will first cut the 7-⅝" pipe, then another cutting tool that will cut 10-¾" diameter pipe, etc. If the inner casing collapses, the job becomes even more complicated and the casing needs to be drilled out or severed by an explosive to remove the smallest diameter casing. The conventional three-blade tool has cutter blades equidistantly spaced about the circumference of the tool body. The distance between the cutter blades in a conventional tool suitable for fitting into the smallest diameter pipe is relatively small. Since the inner diameter of the tubular has very small tolerances, the cutter blades have to be sufficiently small, as well, to allow lowering into the small diameter innermost tubular. The cutter blades of a conventional tool are often damaged, requiring pulling the tool to the surface and starting the process again. The painstaking process takes several days over the use of conventional tools.

If the inner casing collapsed, it may become completely impossible to mill out the necessary portions of the tubulars. In that case, the casing must be cut from the outside, first excavating the mud around the casing to the required depth and then applying the cutting tool to do the job. Such procedure is also expensive and takes several days.

My casing cutter tool disclosed in U.S. Pat. No. 7,063,155 solves the above-described problems by providing a casing cutter that has a pair of cutter blades pivotally mounted on a support body. The blades are pivotally mounted for gradual movement outside of the support body when downward force is applied to proximate ends of the cutter blades. The support body is rotated inside the innermost of the multiple tubulars, while the cutter blades sever the tubulars of progressively increasing diameter. The cutting blades have a main top surface and a distal end wall. The cutting elements are located on the main top surface and on the distal end wall. When the cutter blades are gradually pivotally moved from an idle position recessed in the hollow body to a position substantially perpendicular to the vertical axis of the body the top surface mills out a window in the casing, severing the casing to allow a subsequent plugging operation to take place.

While the tool of the '155 patent works satisfactory, it was observed during the tests that the cutter blades or the pivot pins carrying the blades sometimes become damaged, which requires that the tool be repaired with new blades or new pivot pins. Naturally, the blade or pin replacement takes time, which slows the casing cutting process.

The present invention contemplates elimination of the drawbacks associated with the prior art and provision of a casing cutter that can be used for cutting multiple tubulars in an efficient manner that allows to save time and expense of the operation. The cutting tool is reversible, allowing the tool to be turned 180 degrees, with new cutting blades to continue the casing milling operation.

SUMMARY OF THE INVENTION

It is, therefore, an object of the present invention to provide a casing cutter that can be used for severing multiple tubulars below the mud line.

It is another object of the present invention to provide a casing cutter that can be used for cutting various diameter tubulars that have been cemented together in an expeditious and relatively inexpensive manner.

It is still a further object of the present invention to provide an apparatus for severing multiple tubulars while using the same support body provided with two or more locations for attaching the cutting blades.

These and other objects of the present invention are achieved through a provision of an apparatus and method for severing multiple tubulars in a well bore. The apparatus has a hollow support body of a generally cylindrical configuration and an outside diameter smaller than the inner diameter of the innermost of the tubulars. The support body has a longitudinal slot extending through diametrically opposite location of the support body. The ends of the support body are provided with external threads allowing reversible engagement of the support body to a downhole work string.

A pair of strong cutter blades is pivotally mounted in relation to the support body; the cutter blades are recessed in the support body when the apparatus is in an idle position. A piston mounted in the support body moves in a vertical direction pushing the cutter blades and causing the cutter blades to pivot, while gradually extending through the slot of the support body into contact with the tubulars. A rotational force is applied to the support body, causing the cutter blades to sever the innermost of the multiple tubulars by the surfaces of the cutter blades that are provided with cutting material, such as tungsten carbide.

The support body is provided with a second piston that remains idle while the first piston operates on the cutter blades. Should the original set of the cutter blades become unusable, the support body is turned over, the original cutter blades are detached, and a substitute set of the cutter blades is attached for movement by the second piston that is positioned in a mirror-image position inside the support body. The piston is then caused to contact the substitute set of the cutter blades and cause their movement into an operational position for cutting the tubulars.

Cutting material may be provided on a top surface of a cutter blade, or on both top and bottom surfaces of the cutter blades so that the cutting operation can be performed whether the support body is moved up or down within the tubulars.

BRIEF DESCRIPTION OF THE DRAWINGS

Reference will now be made to the drawings, wherein like parts are designated by like numerals and wherein.

DETAILED DESCRIPTION OF THE INVENTION

Figure 9:
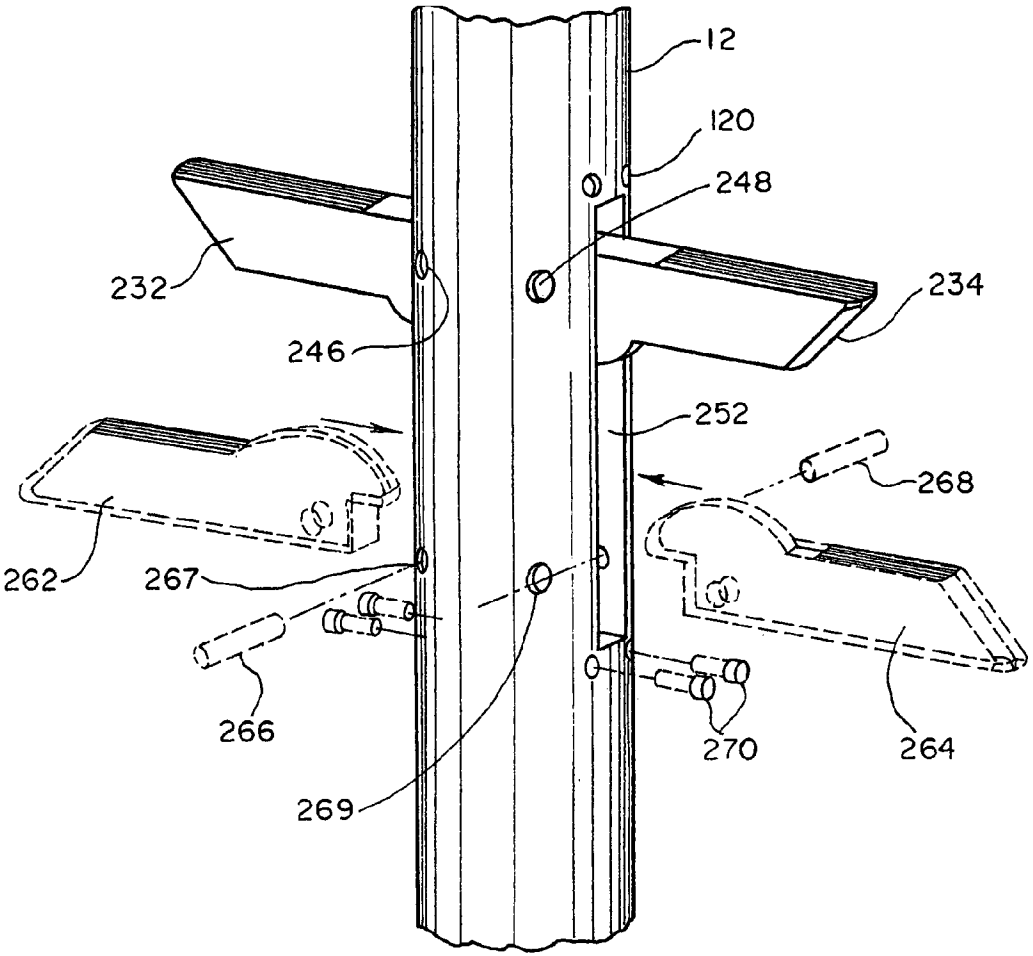
FIG. 9 is a detail view showing alternative embodiments of the cutter knives designs.

Turning now to the drawings in more detail, numeral 10 designates the cutting tool in accordance with the present invention. The cutting apparatus 10 comprises a cutter body 12 configured as an elongated hollow body with a pair of longitudinal slots 14 and 16 formed in the side wall of the body 12. The slots 14 and 16 are open to the interior of the body 12, forming a through opening that communicates with diametrically opposite sides of the cylindrical side wall. An upper annular shoulder 18 is formed above the slots 14 and 16. A lower shoulder 22 is formed below the slots 14 and 16.

An optional magnet retrieval tool 20 can be detachably secured to a first end 15 the tool body 12 and a second optional magnet retrieval tool 24 can be secured to the second end 17 of the tool body 12. The ends 15 and 17 of the body 12 are provided with threaded subs 19, 21, respectively allowing connecting of the cutter body 12 to a string (not shown) that lowers the tool body 12 into a well bore.

A pair of cutter blades or knives 32 and 34 is pivotally secured to the support body 12. In an idle position, the blades extend in a generally parallel orientation in relation to the longitudinal axis of the body 12 and are recessed into the slots 14 and 16. Each of the cutter blades 32, 34 has an elongated, rectangular in cross section, configuration. Each cutter blade 32, 34 is provided with openings 36, 38, respectively for receiving pivot pins 40 and 42 therein. The knives 32, 34 have an upper surface 44, 46, respectively, which is encrusted with cutting chips formed of hard non-corrosive material, for instance tungsten carbide.

Figure 3:
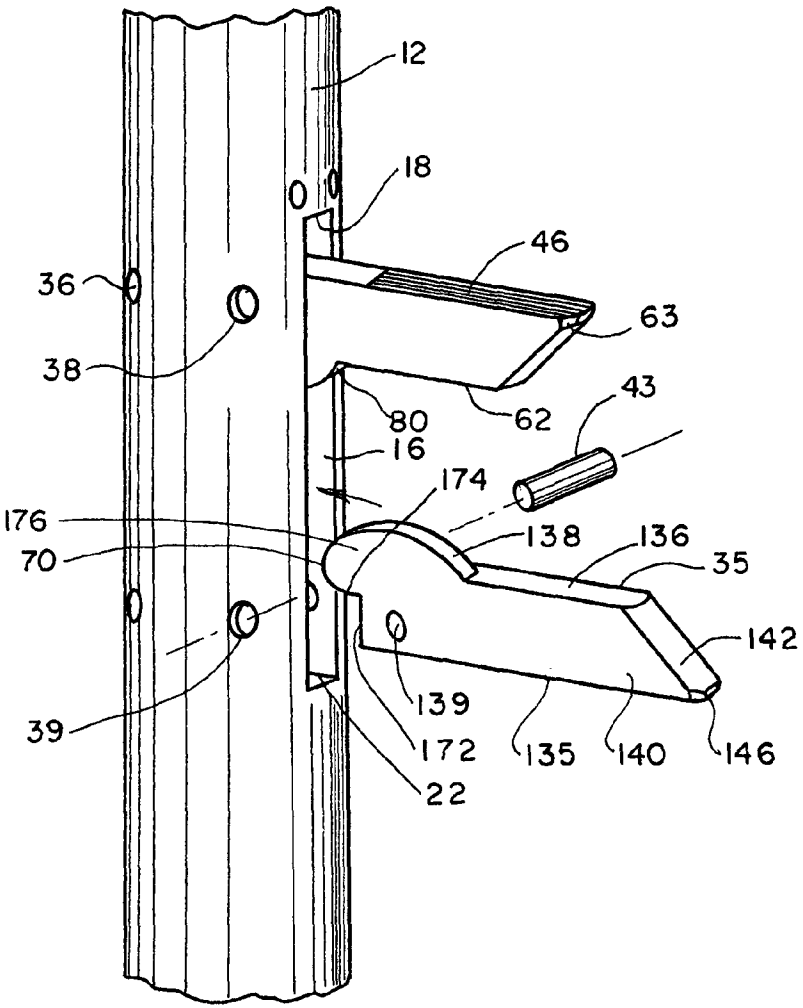
FIG. 3 is a detail view illustrating one of the cutting knives in an engaged position and a reversible cutting knife in a disengaged position.
Figure 5:
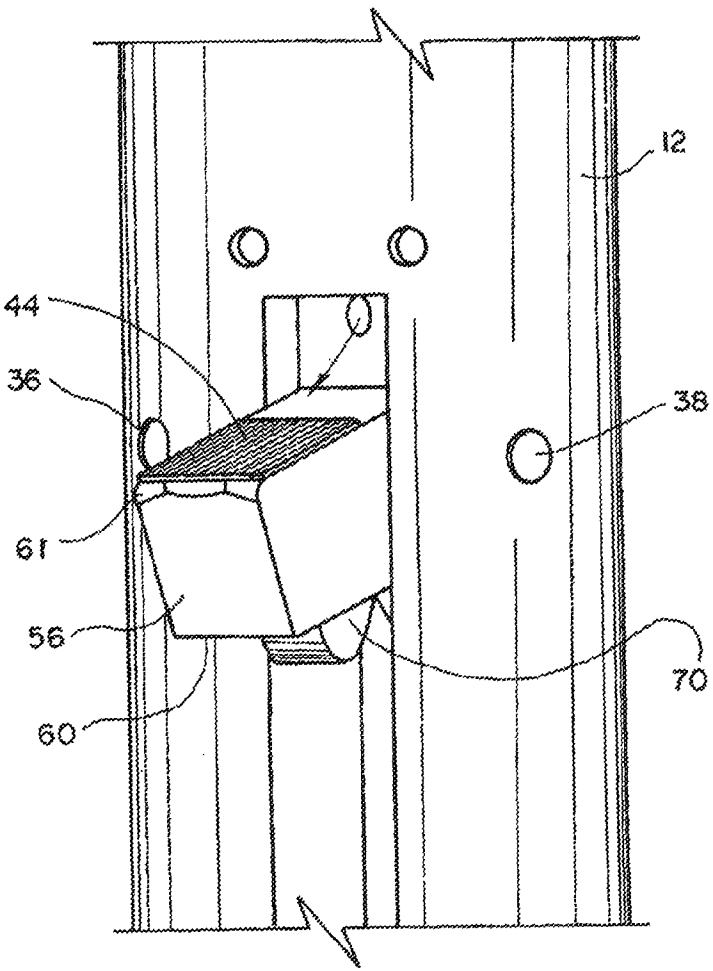
FIG. 5 is a detail view showing a channel for delivering a wash liquid on top of the cutting knife.
Figure 10:
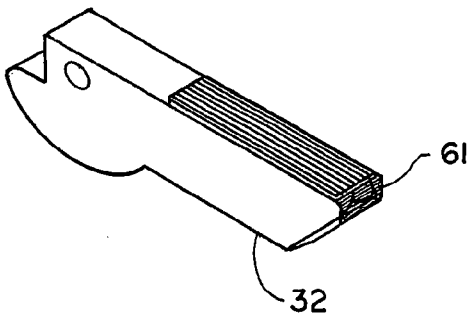
FIG. 10 is a detail view showing a cutter knife with a blunt edge having cutting capabilities.
Figure 11:
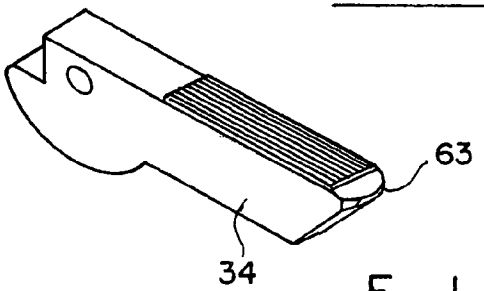
FIG. 11 s a detail view showing a cutter knife with a tip of the knife without a cutting medium.
Figure 12:
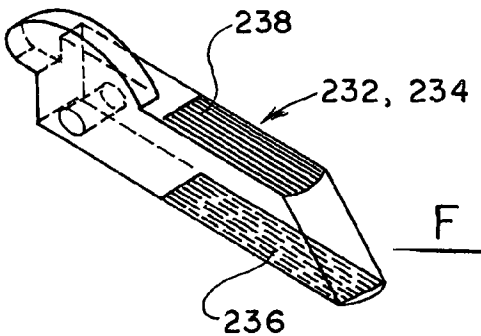
FIG. 12 illustrates an embodiment of the cutter knife with opposing surfaces and the tip of the distal portion having cutting medium located thereon.

The distal end of each knife 32, 34 has angularly cut corners 52, 54. The tips 56, Distal tips 56, 58 of the knives 32, 34 may be sharpened as at 57, 59 and encrusted with cutting chips, similar to the surfaces 44, 46 for performing the initial cut through an innermost casing, or can be formed blunt, such as 61, 63, as shown in FIGS. 3 and 5. The blunt tips 61, 63 extend between the top surfaces 44, 46 and the angular corners 52, 54; the blunt tips 61, 63 may or may not be provided with cutting capabilities, depending on the needs of the operation. FIG. 10 shows a cutter knife 32, which has cutting chips positioned on the blunt end 61, while FIG. 11 shows a cutting knife 34, which blunt tip 63 has no cutting capabilities. The blunt tips 61, 63 of the distal ends 56 and 58 are oriented at an approximately right angle in relation to the upper surfaces 44, 46 and at an obtuse angle in relation to the bottom surfaces 60, 62.

A proximate end of the knife 32 has a "heel" portion 70 which extends forward of a vertical shoulder 72. The heel portion 70 comprises a flat surface 74 and a rounded part 76 extending at a right angle to the vertical shoulder 72. The pivot pin opening 36 extends through the heel portion 70 as well.

Figure 2:
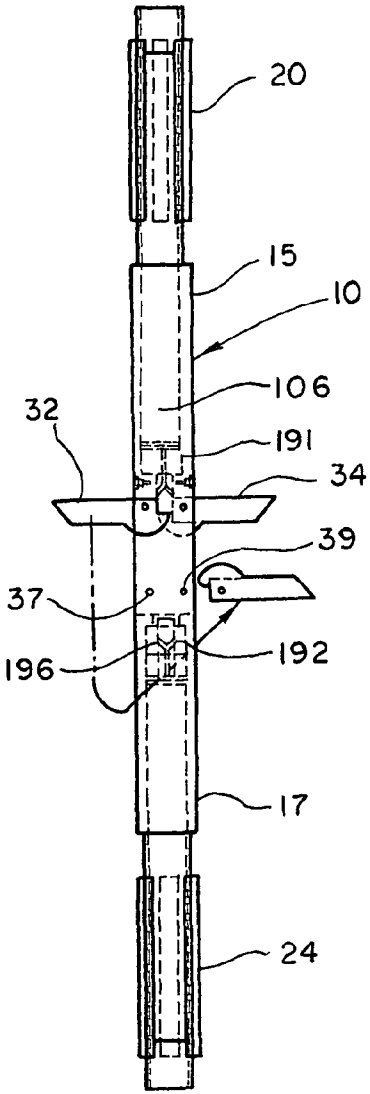
FIG. 2 is an elevation, partially sectioned view illustrating the piston assemblies mounted inside the tool body.
Figure 4:
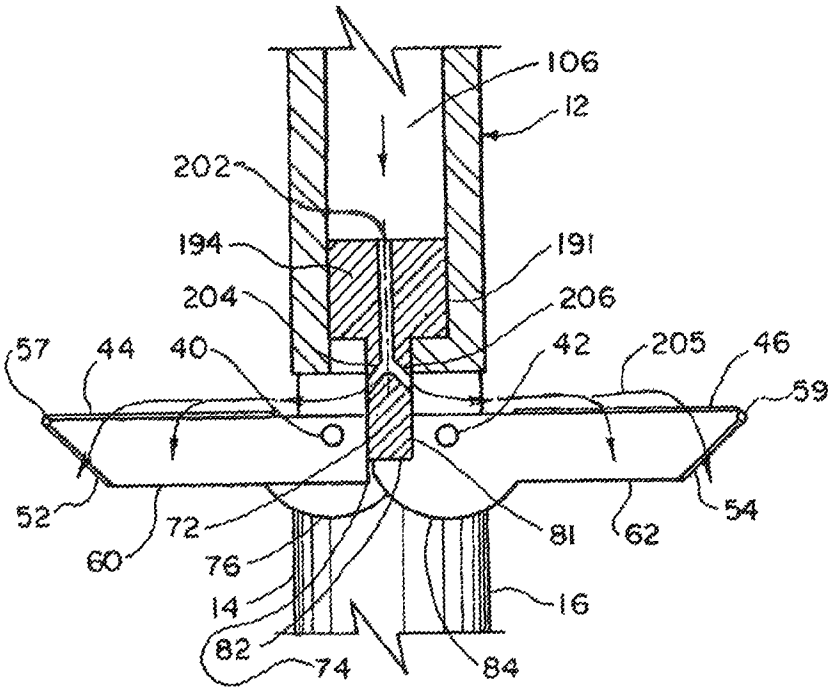
FIG. 4 is a detail view illustrating the cutting blades in a fully extended position.
Figure 7:
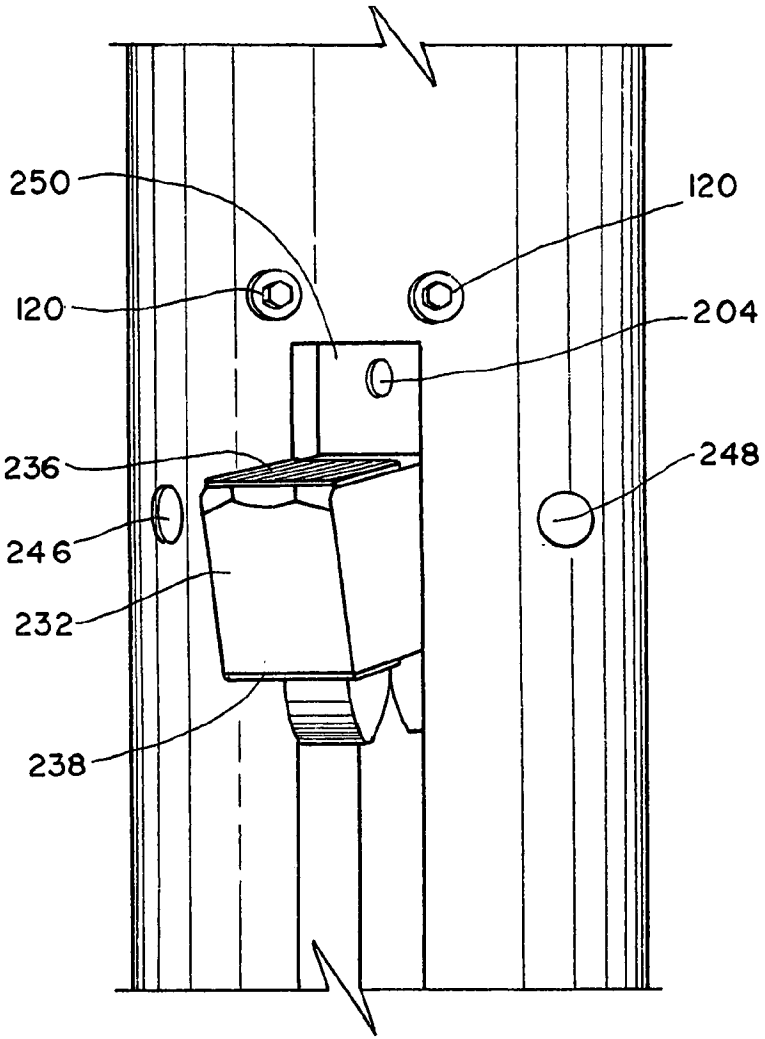
FIG. 7 is a detail view illustrating an alternative embodiment of the cutting knives with opposing surfaces capable of performing a cutting operation.

The knife 34 is a mirror image of the knife 32 and is similarly provided with a heel portion 80, which has a top surface 82, a vertical shoulder 81, and a rounded part 84. When the cutter blades 32 and 34 are secured on the body 12, the heel portions 70 and 80 slightly overlap, as shown in FIGS. 2 and 4.

The body 12 is provided with a second set of opening 37, 39 that are configured for receiving the pivot pins 41, 43 of the reverse cutter knives 33, 35 therein. The knife 33 is substantially similar to the knife 34, while the knife 35 is substantially similar to the knife 32. When the pins 40, 42 become damaged, or the knives 32, 34 become unusable, an operator has an opportunity to continue the milling operation by first pulling out the tool 10 from the well bore and then engaging the end 17 of the tool body 12 in the upper position, in effect turning the tool 10 180 degrees about a vertical axis. In that case, the end 15 of the tool 10 is located below the end 17.

Figure 1:
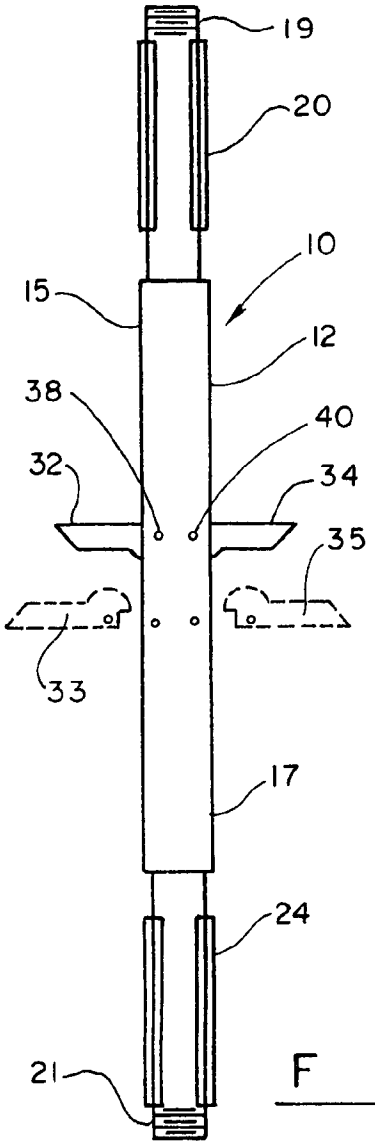
FIG. 1 is an elevation view of the preferred embodiment of the apparatus of the present invention shown with the blades fully extended and reversible knives in phantom lines.

The knife 35 has a cutting surface 135, which carries the cutting material, for instance tungsten carbide. An opposite surface 136 of the knife 35 joins with a heel portion 138. The heel portion 138 is provided with an opening 139 for receiving of the pin 43 therethrough. The heel portion 138 has a rounded part 176, a vertical shoulder 172, and a transverse shoulder 174. The knife 35 has a distal end 140, which has an angularly cut corner 142. The tip 146 of the knife 35 can be sharpened or blunt (as in FIGS. 1 and 11). If sharpened, the tip 146 may be provided with cutting material; if the tip 146 is blunt it may or may not be provided with cutting chips.

The knife 33, similar to the knife 34, also comprises a rounded heel, an upper surface with cutting chips, and a distal end with an angularly cut corner. The knife 33 is detachably pivotally engaged with the body 12, similarly to the knives 32, 34 and 35 by a pivot pin . . . engaged within an opening 37.

Apparatus 10 further comprises a means for transmitting a downward force on the cutter blades 32, 33, 34, and 35. The means for transmitting the downward force comprises a pair of opposing spaced-apart, independently operable piston assemblies 191, 192 configured for movement inside the hollow tool body 12. Depending on the end that is the uppermost in the well bore, whether the end 15 or the end 17, one of the piston assemblies 191, 192 is selectively actuated from the surface, while the piston assembly below the one that has been actuated remains idle.

Each of the piston assemblies 191, 192 comprises a piston body with an enlarged diameter upper portion 194 and a reduced size lower portion 196. An O-ring 200 is fitted in a groove formed in the enlarged portion 194. The upper portion 194 is configured to frictionally engage interior wall of the body 12 when the piston 191 moves through the body 12. The lower portion 196 is unitary connected to the upper portion 194 and has a generally rectangular or square cross-section.

The upper portion 92 has a generally cylindrical configuration. The lower portion 196 has two side walls 197, 198 that extend below the upper portion 194 and terminate at the bottom surface 195 of the upper portion 194. The lower portion 196 is configured to fit between vertical shoulders 72, 81 when the knives 32, 34 are pivoted on the pins 40, 42. This design of the piston 191 allows backside of the knives to be reinforced by reducing tolerances needed for accommodating the tool 10 inside a small diameter tubular. This design provides additional strength, during the cutting or section milling operation.

An opening 202 is formed in the large portion 194 for allowing a wash liquid to be delivered from the surface to the area being cut. The opening 202 branches into a pair of channels 204, 206, which direct the wash liquid in the direction of arrows 205 to the slots 14 and 16 to an area above the upper surfaces 44, 46 of the knives 32, 34, respectively. The liquid washes away any cutting made by the knives 32, 34 and allows then to drop by gravity into the well bore. The cuttings can then be collected by the magnetic tools 24 or 20, depending on which of these tools is below the body 12.

In operation, the reduced size portion 198 of the piston 191 contacts the upper surfaces 74 and 82 of the heel portions 70 and 80, respectively, when the piston 191 moves in the downward direction within a central opening 106 of the body 12. The downward moving force applied to the piston assembly 191 may come from an electric, hydraulic, or pneumatic power source (not shown), to which the piston assembly 191 is connected in a manner known to those skilled in the art.

Figure 8:
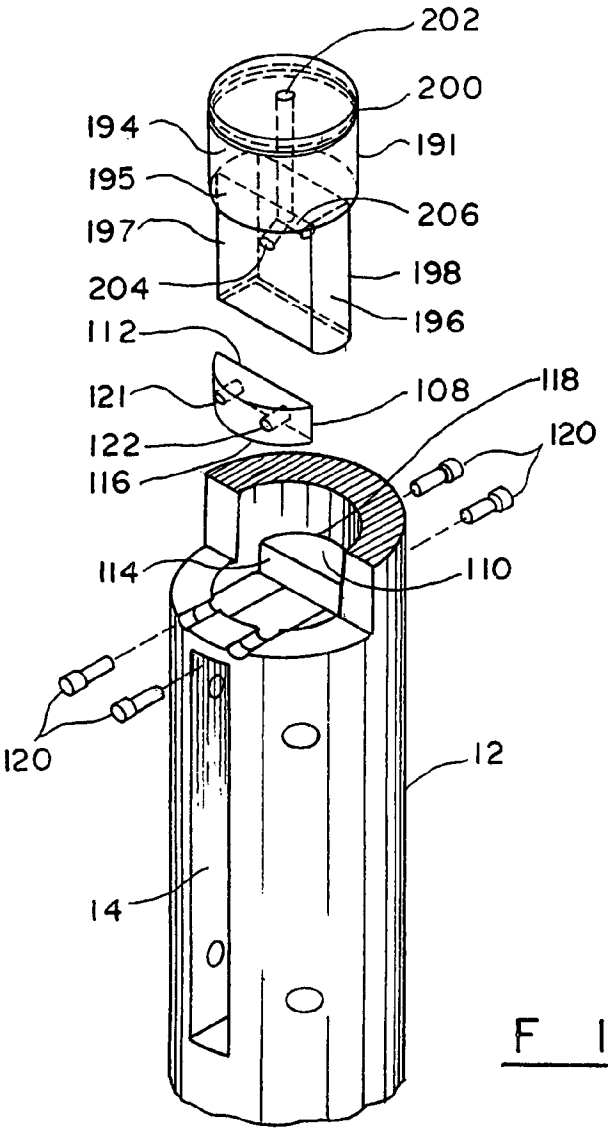
FIG. 8 is detail, partially exploded view showing the piston assembly.

To ensure an axial movement of the piston assembly within the opening 106, the assembly 191 further comprises a pair of piston alignment blocks 108, 110. The piston alignment blocks are aligned to contact the surfaces 197, 198 of the lower portion 196. The blocks 108 and 110 are configured as half disks, with straight surfaces 112, 114 and curved portions 116, 118. The piston alignment blocks 108 and 110 are secured to the piston assembly 191 with the help of tightening members or screws 120 (FIG. 8) such that the flat surfaces 112, 114 extend transversely to the flat surfaces 197, 198 of the lower portion 196. The screws 120 extend through respective openings 121, 122 formed in the piston alignment blocks 108 and 110.

FIGS. 6, 7, 9 and 12 illustrate the use of alternative cutter blades 232, 34 in the apparatus of the present invention. In this embodiment the cutter blades 232, 234 are provided with cutting surfaces formed on the top and bottom surfaces thereof. As can be seen in the drawings, each cutter blade 232, 234 has a first surface 236 and an opposing second surface 238, which may be oriented parallel to the first surface 236. Cutting chips, made for instance of tungsten carbide, are deposited on the surfaces 236 and 238, allowing the cutter blade 232 to cut the casing 240 irrespective of whether the tool 10 is being moved downwardly or upwardly within the casing 240. The cutter blade 234 has a similar structure with opposing cutting surfaces 242, 246.

Figure 6:
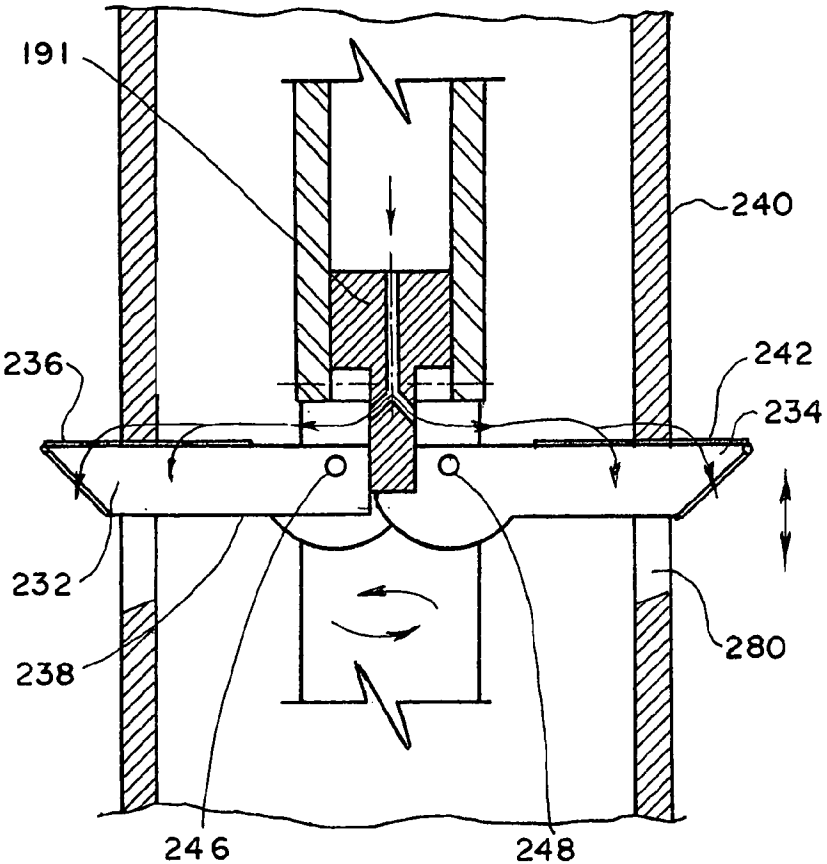
FIG. 6 is a detail view illustrating the cutting knives in a fully extended position cutting through a casing wall.

Similarly to the cutter blades 32, 34, the blades 232, 234 are pivotally secured on the body 12 by suitable pivot pins 246, 248, allowing the blades 232, 234 to move between a recessed, idle position within slots 250, 252 to a gradually extending position, and then to a fully extended position as shown in FIGS. 6 and 9. In this position the longitudinal axes of the blades 232, 234 are oriented substantially perpendicularly to the wall of the casing 240.

FIG. 9 illustrates reversible substitute blades 262, 264, which are configured for pivotal mounting on the body 12 through the use of pivot pins 266, 268. The pins 266, 268 are sized and shaped to fit into openings 267, 269 formed in the body 12. Securing bolts 270 secure the piston retaining blocks (not shown) with the body 12.

Similarly to the embodiment described above, the substitute cutter blades 262, 264 are secured on the body 12 when the tool body 12 is turned 180 degrees about its vertical axis. The blades 262, 264 then perform the cutting operation cutting a "window" in the wall of the casing 240.

In operation, the apparatus 10 is lowered into the smallest diameter pipe or casing 240 to a depth selected for performing the cutting operations. The required depth is such that the cutter blades 32, 34 or 232, 234 are positioned well below the mud line. In conventional oilfield operations the innermost casing 240 may have a diameter as small as 7-⅝". The body of the apparatus 10 is caused to rotate within the casing 240, while the piston 191 presses downward on the heels 70 and 80 of the cutter blades 32, 34 or 232, 234.

Under the influence of the downward force on the piston assembly 191, the cutter blades 32, 34 or 232, 234 pivot about the pivot pins 40, 42, or 246, 248, gradually extending through the slots 14 and 16 into a contact with the innermost tubular. The cutting surfaces of the distal ends 56, 58 begin the first cut through the casing 240. Eventually, a window 280 of about 25 inches is cut through the wall of the casing 240 allowing the knives 32, 34 or 232, 234 to extend through the window.

The same cutting sequence is followed if the tool 10 is pulled upwardly or pushed downwardly within the casing 240. Either the top surfaces or the bottom surfaces of the cutter blades perform the cutting operation. If desired, the cutting operation may start with using a pair of blades having sharpened tips and the subsequent milling operation can be performed using cutter blades with blunt tips so as not to damage or disturb the next size casing.

Once the first casing is severed, the tool 10 is retrieved to the surface, and a longer set of cutter blades is secured on the support body 12. The longer set of the cutter blades still fits in the recesses formed by the slots 14 and 16. Once the tool is lowered to the depth where the new set of the cutter blades is aligned with the previously cut slot in the casing 240, rotational force is again applied to the body. At the same time, the new set of the cutter blades is extended through the preformed slot to continue the cutting operation through the next adjacent tubular and the cementing media.

Depending on the number of casings to be cut through, progressively longer blades are secured to the support body 12 and lowered into the well bore. The same support body 12 can carry the cutter blades for cutting large diameter tubulars, for instance a 30" casing. In such cases, the cutter blades 32, 34 are pivoted to extend almost perpendicularly to the longitudinal axis of the support body 12 to a position schematically shown in the drawings. The casing cutting operation can be performed even if the cutter blades are not oriented strictly perpendicular to the longitudinal axis of the casing 240. With partially extended cutter blades, the casing cutting operation can still be performed. The cutter blades of the apparatus of the present invention are allowed to self-align depending n the resistance offered by the casing wall of cementing medium in the casings. As a result, an operator can plug successively larger diameter casing, if necessary, while preventing oil leakage into the surrounding environment. This process continues until the outermost casing is severed.

The apparatus of the present invention allows severing of multiple casings that are cemented together using a two-bladed cutter. The support body 12 fits within the narrowest casings, while carrying cutter blades to cut even large diameter casings. The initial cut with the shortest set of knives 32, 34 is used for extending longer knife blades through the window and continue cutting operations at the same depth, while continuously increasing the lengths of the blades 32, 34 until the most outside casing is severed.

In comparison with conventional methods, the apparatus of the present invention allows to eliminate the milling from an outside of the casings, while severing the multiple tubulars at the desired depth in the matter of 1-½ to 2 days. The apparatus of the present invention allows severing of the multiple tubulars even when the tubulars are not co-axially aligned.

The cutting blade of the present invention allows cutting with the ends of the cutter blades 56, 58 and with the top surfaces 44, 46 of the blade, as well as bottom surfaces of the blades 232, 234. In conventional three bladed cutters, the knives are about 1 inch wide. With the two bladed cutter of the present invention, the cutter blades can be up to 3 inches wide, which makes them stronger and allows to reach out into the outermost casing.

Many other changes and modifications may be made in the design of the present invention without departing from the spirit thereof. I, therefore, pray that my rights to the present invention be limited only by the scope of the appended claims.

We claim:

1. An apparatus for severing multiple tubulars in a well bore, comprising:

an elongated hollow body adapted for receiving torque from an external rotational source, said body having a first end and a second end, said hollow body comprising a pair of opposing longitudinal slots formed in a sidewall of said hollow body to allow passage of a pair of cutter blades in opposite directions therethrough;

a means for pivotally securing a first set of cutter blades proximal a first end of said body, formed in said body;

a first set of cutter blades pivotally secured adjacent a first end of said body, by said means for pivotally securing said first set of cutter blades, said cutter blades comprising cutting surfaces formed on at least one side of the cutter blades;

a means for pivotally securing a substitute set of cutter blades on said tool body, formed proximal a second end of said body;

a means for pivotally moving said first set of cutter blades from an idle position recessed in said hollow body to a position wherein said first set of cutter blades are in cutting contact with a tubular wall, said means comprising a central opening in said hollow body, said central opening having a first section in an uppermost position when said body is positioned in a well bore, and a first piston assembly slidably mounted in said first section, said first piston assembly being actuated by a downward force acting on said first piston assembly and moving same into operable contact with said first set of cutter blades, said central opening further comprising a second section, spaced apart from said first section, for accommodating a second piston assembly when said apparatus is inverted in said well bore, said second piston assembly having an actuating direction opposite to that of said first piston assembly.

2. The apparatus of claim 1, further comprising a means for lowering said body into the well bore, said means being formed on said first end and said second end of said body.

3. The apparatus of claim 1, wherein each of said cutter blades comprises a top surface and a bottom surface, and wherein cutting material is positioned on at least the top surface.

4. The apparatus of claim 1, wherein each of said cutter blades comprises a top surface and a bottom surface, and wherein cutting material is positioned on said top surface and said bottom surface.

5. The apparatus of claim 1, wherein each of said cutter blades comprises a proximate end pivotally secured to said body, and a distal end.

6. The apparatus of claim 5, wherein said distal end has an angularly cut corner.

7. The apparatus of claim 5, wherein said distal end is provided with a sharpened point to facilitate cutting of the tubulars in the well bore.

8. The apparatus of claim 5, wherein said distal end is formed with a blunt tip to prevent the cutter blades from damaging adjacent casing wall.

9. The apparatus of claim 8, wherein cutting material is provided on said blunt tip to facilitate cutting of the tubulars.

10. The apparatus of claim 1, wherein each of the piston assemblies comprises a piston member having an enlarged portion configured to frictionally engage an interior wall of said body and a reduced size portion adapted for contacting the cutter blades while moving downwardly.

11. The apparatus of claim 10, wherein an opening is formed through said enlarged portion, said opening branching into side channels for delivering a flow of wash liquid onto cutting surfaces for removing cuttings from said cutting surfaces.

12. The apparatus of claim 11, further comprising a magnetic assembly for capturing cuttings produced during tubular cutting operations, said magnetic assembly being located downstream from said cutter blades.

13. The apparatus of claim 1, wherein said hollow body has a side wall, and wherein a cutout is formed in the side wall for receiving the cutter blades therein when the cutter blades are in an idle recessed position.

14. The apparatus of claim 13, further comprising a means for mounting said cutter blades on said body, said means comprising a first set of opposed openings for receiving pivot pins of the cutter blades therein.

15. The apparatus of claim 14, further comprising a means for reverse mounting of a substitute pair of cutter blades on said body, said reverse mounting means comprising a second set of openings formed in said body for receiving pivot pins of a substitute pair of cutter blades.

16. The apparatus of claim 1, wherein said first set of cutter blades is removed from said apparatus and a substitute set of cutter blades is pivotally secured adjacent a second end of said body, by said means for pivotally securing said substitute set of cutter blades, said substitute set of cutter blades comprising cutting surfaces formed on at least one side of said substitute set of cutter blades; and wherein said first piston assembly is removed from said apparatus; and further comprising a means for pivotally moving said substitute set of cutter blades from an idle position recessed in said hollow body to a position wherein said substitute set of cutter blades are in cutting contact with a tubular wall, said means comprising a second piston assembly slidably mounted in said second section of said central opening and having an actuating direction opposite that of said first piston assembly, said second piston assembly being actuated by a downward force acting on said second piston assembly and moving same into operable contact with said substitute set of cutter blades, when said apparatus is inverted in a well bore and said second section is positioned above said first section.

17. The apparatus of claim 1, wherein said first set of cutter blades are removed from said apparatus and a substitute set of cutter blades is pivotally secured adjacent a second end of said body, by said means for pivotally securing said substitute set of cutter blades, said substitute set of cutter blades comprising cutting surfaces formed on at least one side of said substitute set of cutter blades; and further comprising a means for pivotally moving said substitute set of cutter blades from an idle position recessed in said hollow body to a position wherein said substitute set of cutter blades are in cutting contact with a tubular wall, said means comprising a second piston assembly slidably mounted in said second section of said central opening and having an actuating direction opposite that of said first piston assembly, said second piston assembly being actuated by a downward force acting on said second piston assembly and moving same into operable contact with said substitute set of cutter blades, when said apparatus is inverted in a well bore and said second section is positioned above said first section.

18. A method of severing multiple tubulars in a well bore, comprising the steps of:

providing a hollow support body carrying a pair of pivotally moveable cutter blades;

providing a means in said hollow body for securing a substitute pair of cutter blades;

providing a means for applying pivotal force on the cutter blades and for moving the cutter blades outwardly from the support body;

lowering the support body into the innermost of said multiple tubulars;

applying rotational force to said support body and causing the cutter blades to pivotally extend from said support body while cutting through one or more of said multiple tubulars;

detaching said cutter blades from said support body, engaging a substitute set of cutter blades to said tool body, rotating said support body by 180 degrees about a horizontal axis, and then further lowering the support body into the well bore for further tubular cutting operations.

19. The method of claim 18, wherein each of said cutter blades is provided with a first surface and a second surface, and wherein cutting material is located on at least a first surface.

20. The method of claim 18, wherein each of said cutter blades is provided with a first surface and a second surface, and wherein cutting material is located on said first surface and said second surface.

21. The method of claim 20, wherein said first surface is oriented substantially parallel to said second surface.

22. The method of claim 20, wherein said first surface is non-parallel to said second surface.

23. The method of claim 18, further comprising a step of providing a means for applying a downward force on proximate ends of the cutter blades.

24. The method of claim 23, wherein said step of providing a means for applying a pivotal force comprises a step of providing a piston adapted for sliding movement within said support body and for contacting said cutter blades to cause pivotal rotation of the cutter blades in relation to said support body.

25. The method of claim 23, wherein said step of providing a means for applying a pivotal force comprises a step of providing a first piston adapted for sliding movement within said support body and applying downward force on the cutter blades to cause pivotal rotation of the cutter blades in relation to said support body from a position recessed in said tool body to an operational tubular cutting position, and a second piston spaced apart from said first piston, said second piston being adapted for independent sliding movement within said support body and adapted for contacting said substitute cutter blades to cause pivotal rotation of the substitute cutter blades in relation to said support body from a position recessed in said tool body to an operational tubular cutting position.

* * * * *